US009616549B2

(12) United States Patent
Nabb

(10) Patent No.: US 9,616,549 B2
(45) Date of Patent: Apr. 11, 2017

(54) DUST COLLECTION SYSTEM FOR AN ORBITAL SANDER

(71) Applicant: Sherril Nabb, Palm Bay, FL (US)

(72) Inventor: Sherril Nabb, Palm Bay, FL (US)

( * ) Notice: Subject to any disclaimer, the term of this patent is extended or adjusted under 35 U.S.C. 154(b) by 0 days.

(21) Appl. No.: 14/253,036

(22) Filed: Apr. 15, 2014

(65) Prior Publication Data

US 2014/0357168 A1 Dec. 4, 2014

Related U.S. Application Data

(60) Provisional application No. 61/828,934, filed on May 30, 2013.

(51) Int. Cl.
*B24B 55/10* (2006.01)

(52) U.S. Cl.
CPC ..... *B24B 55/10* (2013.01)

(58) Field of Classification Search
CPC ..... B24B 55/10
USPC ..... 451/456
See application file for complete search history.

(56) References Cited

U.S. PATENT DOCUMENTS

| | | | | |
|---|---|---|---|---|
| 3,022,806 | A * | 2/1962 | Johnston | 144/252.1 |
| 3,882,644 | A * | 5/1975 | Cusumano | 451/359 |
| 5,791,979 | A * | 8/1998 | Duncan et al. | 451/456 |
| 6,027,399 | A * | 2/2000 | Stewart | 451/353 |
| 6,224,471 | B1 * | 5/2001 | Clowers et al. | 451/359 |
| 6,758,731 | B2 * | 7/2004 | Dutterer et al. | 451/357 |
| 7,118,609 | B2 | 10/2006 | Valentini | |
| 8,070,862 | B2 * | 12/2011 | Woo et al. | 96/69 |
| 8,282,447 | B1 * | 10/2012 | Buser | 451/451 |
| 8,371,907 | B2 * | 2/2013 | Clayton | 451/344 |
| 2003/0032381 | A1 * | 2/2003 | Dutterer et al. | 451/357 |
| 2005/0287938 | A1 * | 12/2005 | Kodani et al. | 451/359 |
| 2007/0161344 | A1 * | 7/2007 | Clayton et al. | 451/456 |
| 2008/0171501 | A1 * | 7/2008 | Woods et al. | 451/451 |
| 2010/0285729 | A1 * | 11/2010 | Loveless et al. | 451/456 |
| 2011/0177763 | A1 * | 7/2011 | Clayton | 451/344 |

FOREIGN PATENT DOCUMENTS

| | | | | |
|---|---|---|---|---|
| JP | 2009190132 A * | 8/2009 | | |
| WO | WO 2010087072 A1 * | 8/2010 | | B24B 55/10 |

* cited by examiner

*Primary Examiner* — Joseph J Hail
*Assistant Examiner* — Marc Carlson
(74) *Attorney, Agent, or Firm* — Global Intellectual Property Agency, LLC; Daniel Boudwin

(57) ABSTRACT

A dust collection system for an orbital sander is provided to assist a user in containing residual dust particles when sanding. The device includes a stretchable band, a flexible transparent housing, and a vacuum hose portal. The stretchable top band has a fastening system that fastens around the neck of the sander to create a seal. The flexible transparent housing with an open lower portion fastens closely around a lower region of the sander and a sanding plate, which enables a user to have visibility of the area being sanded. The vacuum hose portal connects to a vacuum hose to suck the dust that is created by the sander. The device can be added to a new orbital sander or retrofitted to an existing orbital sander. The device enables a user to sand in a conventional manner while preventing the spread of dust and debris when using an orbital sander.

5 Claims, 3 Drawing Sheets

DUST COLLECTION SYSTEM FOR AN ORBITAL SANDER

CROSS REFERENCE TO RELATED APPLICATION

Figure 1:
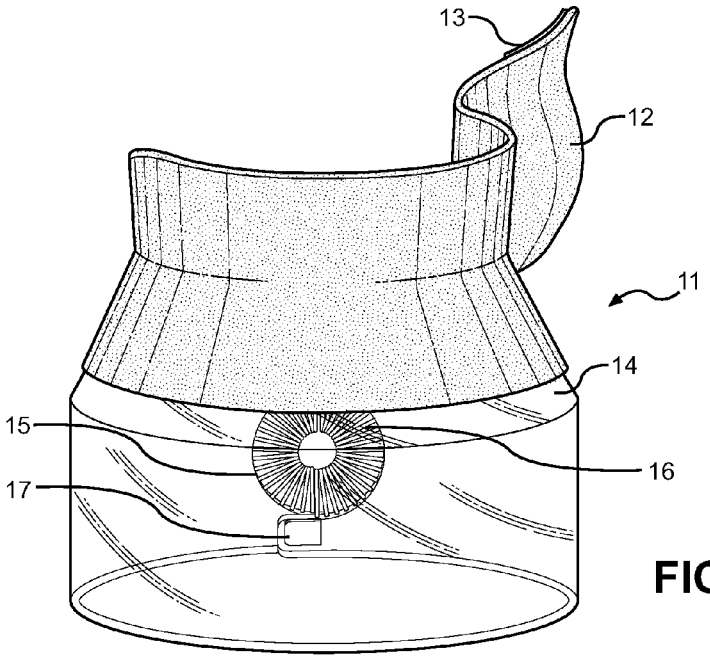

This application claims the benefit of U.S. Provisional Application No. 61/828,934 filed on May 30, 2013, entitled "Orbital Sander Dust Collector." The above identified patent application is herein incorporated by reference in its entirety to provide continuity of disclosure.

BACKGROUND OF THE INVENTION

Field of the Invention

The present invention relates to a dust collection system for an orbital sander. More specifically, the invention relates to a dust collection system including a stretchable top attached to a flexible transparent housing, and a vacuum hose portal therein. The dust collection system can be added to a new orbital sander or retrofitted to an existing orbital sander. The vacuum hose portal is designed to connect to a standard shop vacuum hose, thereby providing an effective means to suck the sanding dust that is created by the sander.

Orbital sanders are hand-held power sanders that use sandpaper disks to sand or finish a variety of work pieces. Sanding produces a lot of dust and debris, which can cause damage to the electronic and mechanical tool parts of the orbital sander over time. Dust and debris can also cause inconvenience to a user and interfere with the sanding process.

Most orbital sanders have an attached bag or canister for collecting dust to prevent dust particles from contaminating surrounding surfaces. Unfortunately, these bags can fill up quickly, requiring a user to frequently stop sanding to empty the bag. Additionally, the bags do not completely eliminate dust and debris particles from becoming airborne. Exposure to dust and debris may irritate the user, triggering coughing and sneezing. Users with asthma or other lung conditions may be more vulnerable to the effects of dust and debris. Some users may wear a dust mask or a respirator to prevent inhaling dust and debris, but these solutions are inconvenient and may be impracticable. Persisting symptoms may cause a loss of productivity and functionality during sanding.

The present invention is a dust collection system for an orbital sander designed to suck dust and debris produced from sanding, without the need of a bag for collecting dust. The present invention allows for a user to contain dust and debris produced from sanding while having a clear working area. Installation of the present invention is convenient, allowing users to add or retrofit the device over an orbital sander and connect a shop hose thereto. The flexible top band fits snugly around an upper portion or a neck of the orbital sander, while the flexible transparent housing is placed around the middle and lower portion of the orbital sander. The top band and the housing are secured tightly with a fastener. In this way, the present invention creates a seal around the orbital sander, preventing dust and debris created from sanding to become airborne. The transparent housing also allows users to see the working surface and the area immediately surrounding the sander without interfering with the sanding process. Additionally, a portal located in the rear of the housing allows users to connect a vacuum hose or a built-in vacuum hose adapter to the housing. The portal further includes a brush sealing along its interior perimeter, which closes the gap around the portal when a vacuum hose is connected therethrough. The use of the present invention decreases dust and debris in the surrounding area without requiring a user to regularly empty a dust collection bag, improving work efficiency. The present invention is ideal for use in homes, workshops, and other similar venues.

DESCRIPTION OF THE PRIOR ART

There are several devices in the prior art that are designed to contain dust and debris produced from sanding. These include devices that have been patented and published in patent application publications. These devices generally relate to devices that include a built-in dust collection bag attached to an orbital sander. These devices, however, are generally designed to hold a small amount of dust, requiring users to frequently empty the bag. The prior art also fail to eliminate airborne dust and debris because these devices do not include a housing or a guard near the sanding plate. As a result, excess dust created from sanding interferes with the working area and irritate the users. The following is a list of devices deemed most relevant to the present disclosure, which are herein described for the purposes of highlighting and differentiating the unique aspects of the present invention, and further highlighting the drawbacks existing in the prior art.

One such device in the prior art is U.S. Pat. No. 8,070,862 to Woo. The Woo device discloses a device for collecting dust for a sanding tool, comprising a bag with three layers and a coupler attached to the bag. Utilizing multiple layers allow the bag to capture fine dust particles and improve the performance of the sanding tool. While the device of Woo is capable of containing loose dust and debris particles created from sanding, the Woo device requires a user to frequently empty the bag throughout use. The Woo device is further limited to being connected to a sanding tool that has a self-generated vacuum. As such, the Woo device cannot be used with non-vacuum orbital sanders. The present invention can be added to any new or existing orbital sanders, and does not require the user to constantly empty a reservoir collecting the dust during use.

Similarly, U.S. Pat. No. 6,758,731 to Dutterer describes an orbital sander with a built in dust collection system. The device includes a fan chamber, dust collection ports, and a rotating fan. The dust created from sanding is drawn into the fan chamber, and is collected in a dust collection canister made from plastic tube frame and a fabric bag. While the Dutterer device collects and contains dust produced from sanding, the dust collection canister only holds limited amount of dust, requiring the user to stop and frequently empty the canister. The present invention does not require a canister or a bag attached to the orbital sander. Rather, the present invention preferably utilizes a shop vacuum, significantly reducing the number of times the user would have to empty out the dust. Additionally, the Dutterer device does not address the issue of collecting dust not drawn into the fan chamber, which could become airborne. The present invention includes a transparent housing around a sanding plate that acts as a guard to prevent dust from interfering with the work area and from becoming airborne, enabling the user to work more effectively.

Another device, U.S. Pat. No. 6,224,471 to Glowers discloses a dust collection system comprising a dust collection housing capable of entrapping dust. The housing is designed to be compact so that it is suitable for palm-grip sanders. Even though the Glowers device collects dust and debris, the purpose and design of the Glowers device diverges in intent and design from the present invention, which discloses a dust collection system having a housing for preventing airborne dust and debris. Unlike the enclosed housing in Glowers, the housing in the present invention has an open lower region to allow a user to sand a work surface in a conventional manner. Additionally, the present invention discloses a vacuum hose portal for connecting to a store vacuum, which contains a large reservoir. As such, the present invention diverges from compact housing design of Glowers.

Yet another prior art device, U.S. Pat. No. 8,371,907 to Clayton describes a sanding device comprising a plenum that may be coupled to a vacuum source by means of a plenum exhaust. The plenum exhaust picks up debris created from sanding and the debris is deposited into a plenum that is integrated into the sanding device. The Clayton device picks and draws dust at an angle to accommodate angled rotary sanding devices. While the device of Clayton is similar in nature in that it provides suitable means to remove dust from the work surface via a hose and a coupled vacuum source, the device differs in that it fails to provide a housing around the sanding plate, and further differs in that the plenum requires frequent emptying. Specifically, the present invention uses a store vacuum to pick up and collect dust and debris produced from sanding. In this respect, the present invention significantly lessens the number of times a user has to empty the vacuum, providing convenience to the user.

Finally, U.S. Pat. No. 7,118,609 to Valentini describes a sanding tool with a built in suction and dust collection capacity. The device comprises a fan, a connection tube, an outlet with a sealing gasket, and a dust collection receptacle. Even though the sealing gasket can seal the dust collected inside the dust collection receptacle, the Valentini device also fails to address the issue of preventing dust from becoming airborne and has a small dust collection capacity. In contrast, the present invention provides a transparent housing that covers the lower portion of an orbital sander around the sanding plate. The housing allows the vacuum to suck dust and debris before the dust and debris spreads out to surrounding work area. Additionally, the present invention does not require a user to clean or empty the dust collection receptacle as frequently as the Valentini device.

The present invention discloses to a dust collection system adapted for use with a new or existing orbital sander. The device comprises a band that attaches over the top of a conventional orbital sander. The band preferably comprises a neoprene material or other suitable stretchable material that securely fastens around the sander. The band is attached to a flexible transparent housing that provides a barrier around the area immediately surrounding the sander. The housing contains the kicked up dust and debris within its perimeter. The housing further includes a portal adapted for a vacuum hose that sucks the sanding dust from the base of the sander. A brush seal around the portal helps secure the vacuum hose in place and closes any gaps between the portal and the vacuum hose. The device can be retrofitted to existing sanders, thereby preventing the need for purchasing a completely new system. While the devices disclosed in the prior art include built-in filtering attachments that include a vacuum bag, none of these devices disclose a dust collection system that prevent dust and debris from becoming airborne and can be retrofitted to an existing sander.

It is submitted that the present invention is substantially divergent in design elements from the prior art and consequently it is clear that there is a need in the art for an improvement to existing dust collection system for an orbital sander. In this regard the instant invention substantially fulfills these needs.

SUMMARY OF THE INVENTION

In view of the foregoing disadvantages inherent in the known types of dust collection system adapted for orbital sanders now present in the prior art, the present invention provides a new device wherein the same can be utilized for providing convenience for the user when a reducing dust and debris from sanding is desired.

It is therefore an object of the present invention to provide a new and improved dust collection system adapted for orbital sanders that has all of the advantages of the prior art and none of the disadvantages.

It is another object of the present invention to provide a dust collection system that may be added to a new orbital sander or retrofitted to an existing orbital sander, offering improved flexibility with respect to the type of orbital sander being installed onto, increasing the number of applications for the same system.

Another object of the present invention is to provide a dust collection system adapted for orbital sanders having a housing member to reduce airborne dust and debris when sanding, wherein the housing member encloses the area around a sanding plate on an orbital sander.

Still another object of the present invention is to provide a dust collection system adapted for orbital sanders having a flexible top band that fits snugly over the neck of an orbital sander to create a seal.

Yet another object of the present invention is to provide a dust collection system adapted for orbital sanders having a shop vacuum hose portal to connect to a vacuum and a large remote receptacle for collecting dust and debris, reducing the frequency that a user has to empty the collected dust.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 displays a front view of the dust collection system of the present invention.

Figure 2:
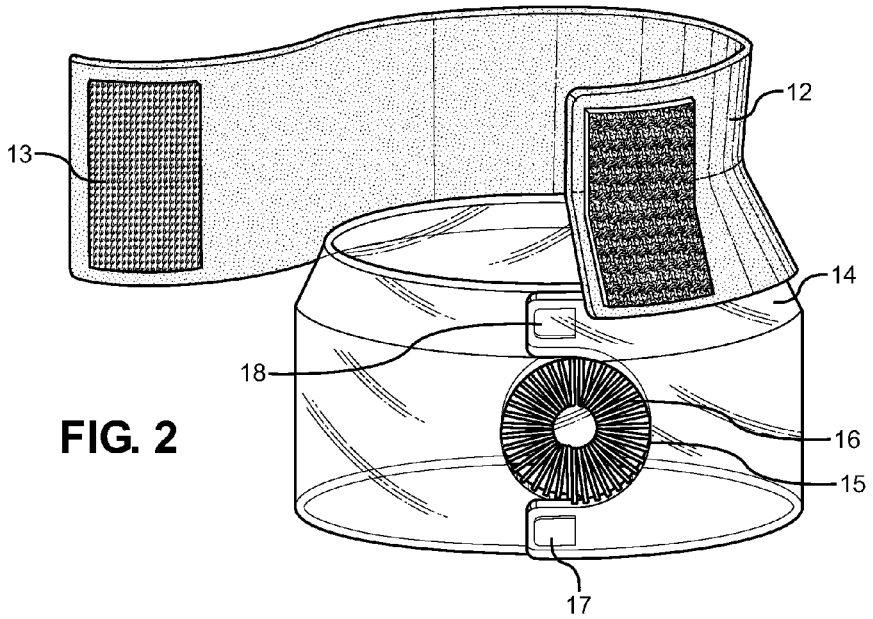

FIG. 2 displays a rear view of the transparent housing of the present invention at its closed state.

Figure 3:
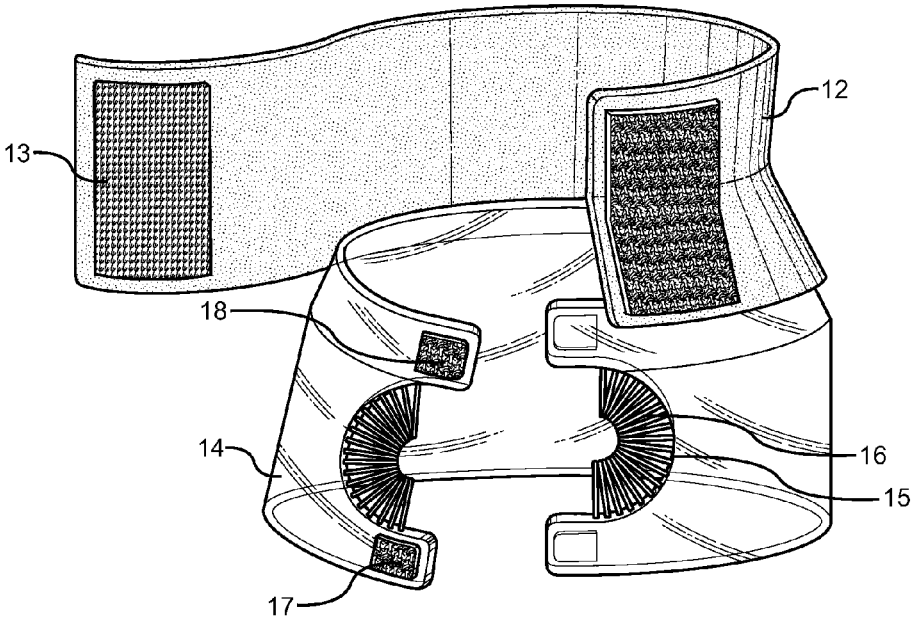

FIG. 3 displays another rear view of the transparent housing of the present invention at its open state.

Figure 4:
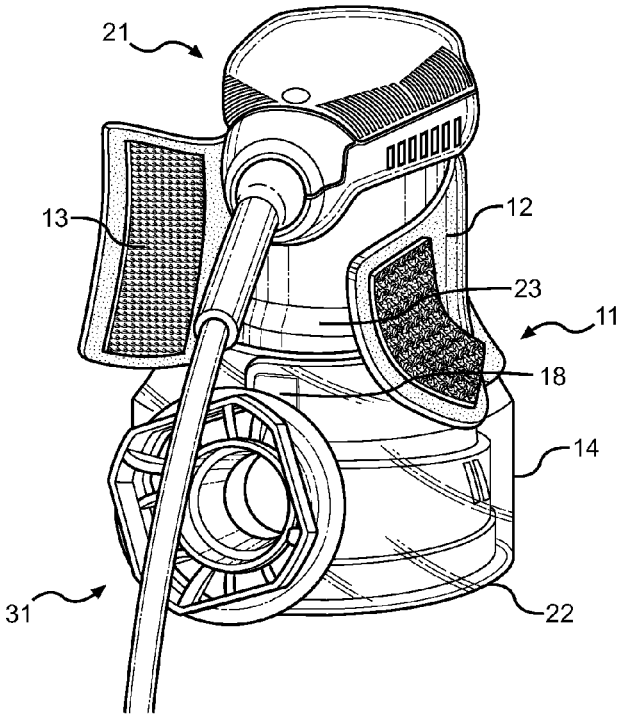

FIG. 4 displays a rear view of the present invention attached to an orbital sander.

Figure 5:
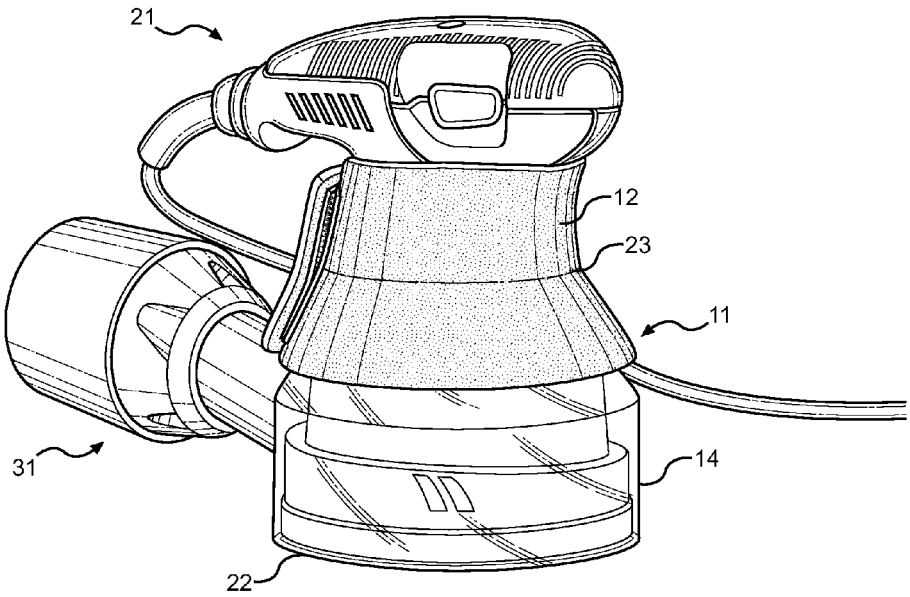

FIG. 5 displays a perspective view of the present invention attached to an orbital sander.

Figure 6:
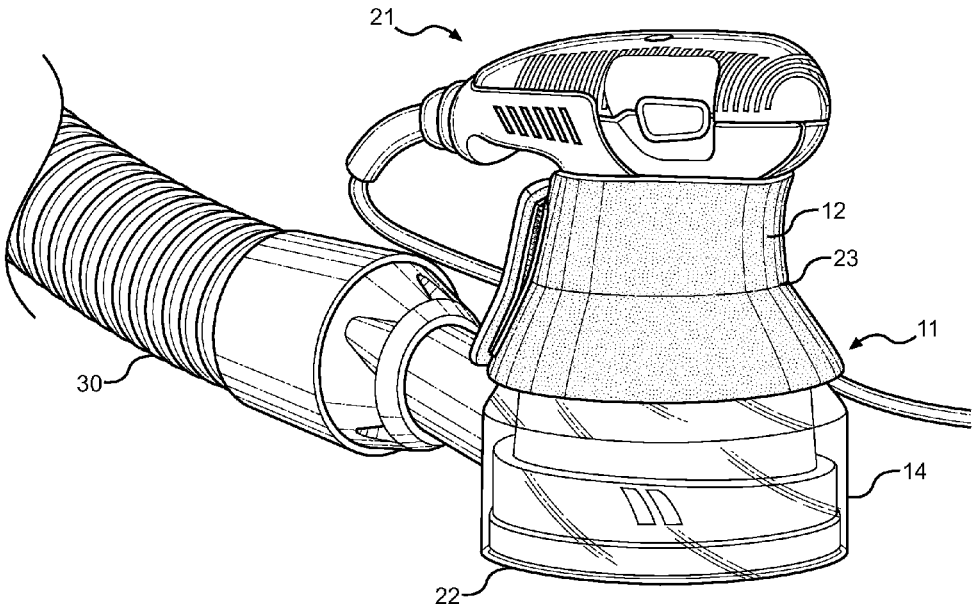

FIG. 6 displays a perspective view of the present invention connected to a vacuum in use.

DETAILED DESCRIPTION OF THE INVENTION

Reference is made herein to the attached drawings. Like reference numerals are used throughout the drawings to depict like or similar elements of the dust collection system. For the purposes of presenting a brief and clear description of the present invention, the preferred embodiment will be discussed as used for collecting the dust and debris from sanding and preventing the dust and debris from becoming airborne. The figures are intended for representative purposes only and should not be considered to be limiting in any respect.

Referring now to FIGS. 1 and 2, there are shown perspective views of the dust collection system 11 of the present invention. The dust collection system 11 comprises a top band 12 that wraps tightly around the neck of an orbital sander 21 with preferably a hook and loop fastener 13 or other suitable fasteners. The top band 12 is substantially rectangular in shape when lying flat, and comprises stretchy and flexible material, such as neoprene, to fit over the neck of an orbital sander 21. A substantial portion of the bottom edge of the top band 12 is attached to the top perimeter edge of a transparent housing 14. The length of the top band 12 is longer than the top perimeter edge of the transparent housing 14 such that one end of the top band 12 slightly overlaps the other end of the top band 12 when it is fastened.

The transparent housing 14 is substantially cylindrical in shape, with an open upper and lower region. The transparent housing 14 is flexible and comprises suitable material such as lightweight plastic. The housing 14 includes a slit in the rear such that a user can bend open the housing 14 to fit around the orbital sander 21. Once the housing 14 is placed around the orbital sander 21, the user can secure it in place by fastening it with preferably a set of hook and loop fasteners 17, 18. The transparent housing 14 is shaped to fit closely around the contours of a variety of orbital sanders 21, and allows a user to have a view of the working surface immediately around the orbital sander 21. The transparent housing 14 and has an open lower region, which is level with a sanding plate, allowing a user to sand a working surface without interfering with the transparent housing 14. The transparent housing 14 prevents dust and debris from being kicked up or away from the enclosed region of the transparent housing, which keeps the dust and debris from becoming airborne. This reduces an exposure to dust and debris that may irritate the user. Users with asthma or other lung conditions may also benefit from the present invention because it reduces inhalation of dust and debris.

The dust collection system 11 also comprises a vacuum hose portal 15 near the back of the dust collection system 11. The portal 15 splits into two halves when the user opens the housing 14, but returns into a single portal 15 when the housing 14 is fastened with the hook and loop fasteners 17, 18. The vacuum hose portal 15 is preferably circular in shape and it is adapted to fit a standard size hose for a shop vacuum. In this way, the user can connect a shop hose directly to the dust collection system 11 by inserting it through the portal 15. Alternatively, the portal 15 can fit around a vacuum hose adapter built into the orbital sander 21. This is particularly useful as most orbital sanders 21 comprise a built-in vacuum hose and a small dust collection bag. In cases where an orbital sander 21 includes a built-in vacuum hose adapter and a dust collection bag, the user would disconnect the dust collection bag and replace it with a standard size shop vacuum hose in the same portal adapted for the dust collection bag. Thus, the portal 15 of the present invention can accommodate to a various types of new and existing orbital sanders 21. The vacuum hose portal 15 further comprises a brush seal 16 located therein. The brush seal 16 may be bent inward or outward with respect to the portal 15 when a vacuum hose is inserted therein. The brush seal 16 helps fill the gap between the portal 15 and a vacuum hose connected therethrough when the present invention is in use. This prevents dust and debris from coming out of the housing 14.

Referring now to FIG. 3, there is shown a view of the top band 12 and the housing 14 in its open state. The slit on the housing 14 is aligned with the two fastening ends of the top band 12 at the rear of the present invention. The housing 14 can be bent to widen the opening to place the orbital sander 21 therewithin. As such, the top band 12 and the housing 14 slides on from the front to the rear of the orbital sander 21 in its open state when a user prepares the orbital sander 21 to be used. Each half of the portal 15 is placed around a built-in vacuum hose adapter on the orbital sander 21 or another connector for a vacuum hose to seal the portal 15. A vacuum hose may be connected to the orbital sander 21 before or after the dust collection system 11 is placed on the orbital sander 21. The top band 12 and the housing 14 can fit around orbital sanders 21 of various sizes by adjusting the fasteners 13, 17, 18. When sanding is complete, a user can unfasten the fasteners 13, 17, 18 and remove the dust collection system 11 for cleaning in a conventional manner and store it for later uses.

Referring now to FIGS. 4, 5, and 6, there are shown views of the present invention attached to an orbital sander 21. The dust collection system 11 can vary in size and shape depending upon the size and shape of the orbital sander 21. A user would attach the dust collection system 11 to an existing orbital sander 21 prior to sanding. The user may fit the dust collection system 11 over the orbital sander 21 so that the lower edge of the transparent housing 14 is level with the sanding plate 22 at the bottom of the orbital sander 21. The top band 12 is tightly fastened with a hook and loop fastener 13 around the neck 23 of the orbital sander 21. In this way, the top portion of the housing 14 is enclosed around the neck 23 of the orbital sander 21 to prevent the dust and debris from coming out of the dust collection system 11. The transparent housing 14 fits snugly around the sander 21 and encloses the area around the sanding plate 22. A user can fit a vacuum hose 30 or a built-in vacuum hose adapter 31 into the vacuum hose portal 15 located near the back of the dust collection system 11.

When the device is attached to an orbital sander 21, a user can sand a working surface in a conventional manner and use a shop vacuum to suck dust and debris from the sander 21 to prevent it from spreading around the surrounding area. The present invention is adapted for use with various types of shop vacuums having a hose attached thereto. In this way, the details of exact type and configuration of the shop vacuum is not of particular importance as the primary purpose of the present invention is to contain the dust created from sanding. Dust and debris from the sander is collected in a receptacle inside the shop vacuum. Because the receptacle for collecting dust inside the vacuum is much larger than compact dust collection bags or canisters, a user can increase work productivity by not stopping to empty dust collection bags as frequently. When sanding is complete, a user can detach the dust collection system 11 and clean the sander 21 and the vacuum in a conventional manner. In this way, the present invention provides a device that helps prevent the spread of dust and debris when using an orbital sander.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dust collection apparatus for an orbital sander with a neck, a lower region, and a sanding plate, comprising:

a top band and a housing, the top band constructed from a stretchable material; the top band being substantially rectangular in shape when lying flat including a first band end, a second band end, a top band edge and a bottom band edge, the first band end and the second band end comprising a band fastener configured to secure the first and second band ends together;

the housing constructed from a flexible material; the housing including a first housing end, a second housing end, a top housing perimeter edge, and a bottom housing perimeter edge, the first housing end and the second housing end comprising a housing fastener configured to secure the first and second housing ends together;

the housing additionally comprising a vacuum hose portal configured to connect to a dust collector, the vacuum hose portal including a seal about an inner perimeter thereof;

the top band being connected to the housing with a substantial portion of the bottom band edge adjacent to the top housing perimeter edge;

the dust collection apparatus configured to be attached to the orbital sander such that the bottom housing perimeter edge is positioned substantially planar with the bottom surface of the sanding plate and the housing wraps around and contours the lower region of the orbital sander and forms a dust collecting area around the sanding plate, the first and second housing ends secured together with the housing fastener;

the top band wraps around the neck of the orbital sander and the first and second band ends secured together with the band fastener.

2. The dust collection apparatus of claim 1, wherein the housing is constructed from a transparent material.

3. The dust collection apparatus of claim 1, wherein the seal includes a brush seal.

4. The dust collection apparatus of claim 1, wherein the housing includes an upper housing section having a frustoconical shape and a lower housing section having a cylindrical shape, the lower section and the upper section forming a unitary structure.

5. The dust collection apparatus of claim 1, wherein the vacuum hose portal is formed by two portal halves with one half on the first housing end and the second half on the second housing end when the first and second housing ends are fastened together.

* * * * *